United States Patent [19]

Grabendike et al.

[11] 4,441,296

[45] Apr. 10, 1984

[54] FIRE RESISTANT WOOD DOOR STRUCTURE

[75] Inventors: James F. Grabendike; Donald E. Grabendike, both of Wichita, Kans.

[73] Assignee: Sun-Dor-Co., Wichita, Kans.

[21] Appl. No.: 330,039

[22] Filed: Dec. 14, 1981

[51] Int. Cl.[3] ..... E06B 3/72

[52] U.S. Cl. ..... 52/456

[58] Field of Search ..... 52/455, 456, 586

[56] References Cited

U.S. PATENT DOCUMENTS 4,265,068 5/1981 Pomroy ..... 52/456

4,367,614 1/1983 Warwick ..... 52/455

FOREIGN PATENT DOCUMENTS 54-47901 1/1979 Japan ..... 52/456

*Primary Examiner*—J. Karl Bell

*Attorney, Agent, or Firm*—Phillip A. Rein

[57] ABSTRACT

This invention is a fire resistant wood door structure designed to pass code and testing laboratories' requirements. The fire resistant wood door structure includes a door assembly having a support frame assembly with a panel assembly connected to the support frame assembly. The support frame assembly includes top, bottom, side, central, and transverse frame members. The panel members include a main body connected through a peripheral edge by a double connector assembly of this invention. The main body and the area of the double connector assembly is of a thickness to pass the testing laboratory burn test requirements. The double connector assembly includes (1) a male connector assembly formed in an outer edge portion of the tapered peripheral edge; and (2) a female connector assembly in the adjacent frame members in the support frame assembly. Each male connector assembly is of U shape in transverse cross section having outwardly projecting leg members with a slot therebetween. The female connector assembly includes a central connector cavity with a central connector projection. On assembly, the leg members fit within the connector cavity with the central connector projection mounted within the slot in the male connector assembly.

4 Claims, 5 Drawing Figures

FIRE RESISTANT WOOD DOOR STRUCTURE

PRIOR ART

A search of the prior art revealed the following U.S. Pat. Nos.: 10,599, 647,627, 2,624,920.

These patents disclose the normal tongue and groove connection but are not designed to provide both a decorative door and pass testing laboratories fire test requirements. The problem is to construct an economical but decorative door structure that passes building code fire test requirements. In the past, this could only be achieved by plain solid wood doors or metal doors.

SPECIAL EMBODIMENT OF THE INVENTION

In one preferred embodiment of this invention, a fire resistant wood door structure is provided which is specifically constructed to increase fire resistance of wood panel door and pass certain testing laboratory requirements to obtain fire resistant status so as to be used by architects in building designs with a panel assembly connected thereto. The door assembly includes a plurality of interconnected frame members leaving spaces there between to be filled in with the panel assembly. The panel assembly includes a plurality of panel members connected to adjacent portions of the frame members by double connector assemblies of our invention. Each double connector assembly includes a male connector assembly in the panel member which connects to and cooperates with a female connector assembly to achieve a maximum fire resistant connection.

OBJECT OF THE INVENTION

One object of the invention is to provide a fire resistant wood door structure of a decorative design having wood panel members secured to a support frame assembly in order to receive (1) a timed, one side flame burn; (2) a hose stream test against the burned side; and (3) pass the test without the panel members from being disengaged from the support frame assembly.

Another object of the invention is to provide a fire resistant wood door structure of intricate and attractive design that can be used in certain instances where normally a metal door or wood flush door must be used pursuant to fire code building requirements.

Still, one other object of the invention is to provide a fire resistant wood door structure having a new and novel double connector assembly to interconnect wooden door panel members to adjacent wooden door support frame assembly to pass testing laboratories requirements to qualify as a "fire resistant door".

One other object of this invention is to provide a fire resistant wood door structure having a new and novel means for connecting door frame members to a support frame assembly providing a sturdy, positive air seal for maximum fire resistant characteristics.

A further object of this invention is to provide a fire resistant wood door structure that resembles a conventional wooden panel door structure; simple to construct and assemble; and passes fire code testing requirements.

Various other objects, advantages, and features of the invention will become apparent to those skilled in the art from the following discussion, taken in conjunction with the accompanying drawings, in which:

FIGURES OF THE INVENTION

Figure 1:
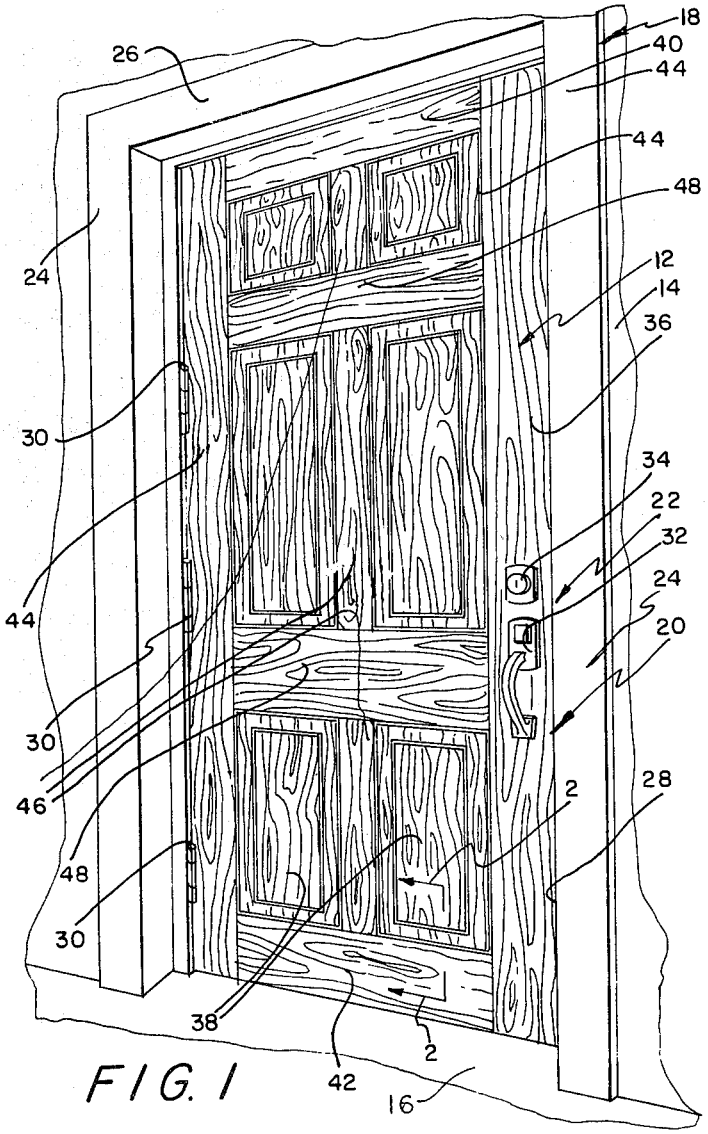
FIG. 1 is a perspective view of a door assembly of this invention shown as connected to an outer frame assembly mounted in a wall structure.

The following is a discussion and description of preferred specific embodiments of the fire resistant wood door structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a fire resistant wood door structure of this invention, indicated generally at 12 is shown in a wall 14 and perpendicular to a support floor 16. The fire resistant wood door structure 12 includes a door assembly 20 of this invention connected to a metal outer frame assembly 18 by a connector assembly 22. The metal outer frame assembly 18 is a conventional structure having parallel side support members 24 with a top member 26 secured thereto. The side support members 24 and the top member 26 are connected to adjacent portions of the wall 14 leaving an opening 28 therein which is selectively closed by the door assembly 20.

The connector assembly 22 includes (1) spaced hinge members 30; (2) a handle assembly 32; and (3) a lock member 34 which pivotally connects and selectively locks the door assembly 20 to the outer frame assembly 18.

The door assembly 20 includes a support frame assembly 36 with a panel assembly 38 connected thereto. The support frame assembly 36 includes (1) a top frame member 40; (2) a bottom frame member 42; (3) parallel spaced side frame members 44; (4) a vertical central frame member 46; and (5) spaced, transverse frame members 48. These aforementioned "frame members" form the basic support structure for the entire door structure 12 and are normally constructed of "1¾ inches" thick wood material.

The connection of the panel assembly 38 to the support frame assembly 36 is the heart of this invention as the panel assembly 38 includes panel members 50 which may be of varying thicknesses for an attractive appearance.

The panel assembly 38 includes the panel members 50 which are connected to adjacent portions of the support frame assembly 36 by a unique double connector assembly 54 of this invention.

More particularly, each panel member 50 includes a central main body 56 having an outer peripheral edge 58 integral therewith which may be tapered or of a thickness equal to that of the main body 56.

Figure 2:
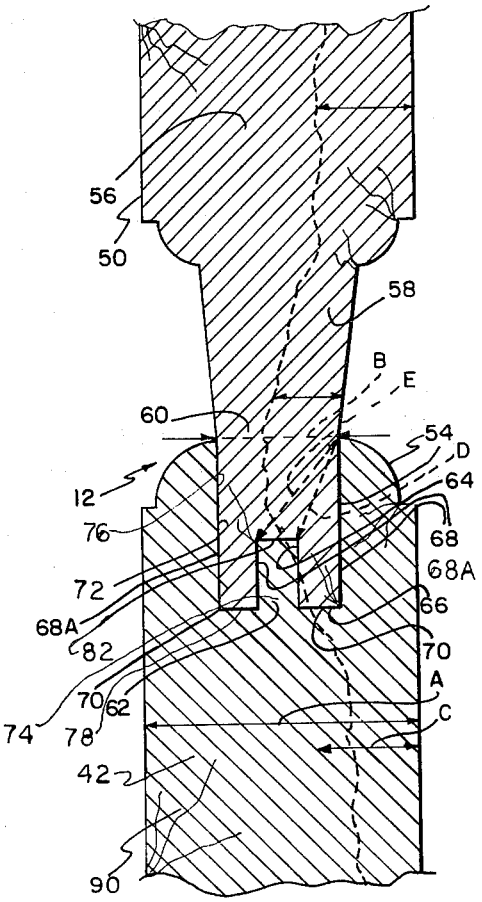
FIG. 2 is an enlarged, fragmentary sectional view taken along line 2 in FIG. 1.

As shown in FIG. 2, the double connector assembly 54 includes; (1) a male connector assembly 60 formed in an outer portion of each peripheral edge 58; and (2) a female connector assembly 62 formed in adjacent portions of the frame members of the support frame assembly 36.

Each male connector assembly 60 is formed from a connector slot 64 formed in an end wall 66 of the tapered peripheral edge 58 to leave spaced, parallel side walls 68. The outermost sidewalls 68 (indicated as "68A") are of a greater length than the inner sidewalls 68 for reasons to be explained. In fact, the adjacent sidewalls 68 form spaced parallel connector leg members 70. The leg members 70 are normally constructed of a thickness equal to each other and the width of the connector slot 64 may vary for reasons to be explained.

Each female connector assembly 62 formed in adjacent portions of the support frame assembly 36 includes a connector cavity 72 with a central connector ledge or projection 74 formed centrally thereof. The connector cavity 72 is defined by parallel inner sidewall surfaces 76 with a bottom wall surface 78 perpendicular to the sidewall surfaces 76.

A center of the bottom wall surface 78 is interrupted by the central connector projection 74. The central connector projection 74 has an outer end wall 82 which ends a substantial distance inwardly of an outer surface 84 of the frame member of the support frame assembly 36 for reasons to be explained. The width of the connector projection 74 is substantially identical to the width of the connector slot 64.

USE AND OPERATION OF THE INVENTION

As noted in FIG. 2, the main thickness of the support frame assembly 36 and the panel members 50 is indicated at "A" which is normally of the "1¾ inch" thickness. If the entire door structure was of this thickness, then such would pass the required fire resistant test and this invention would not be necessary to pass such testing.

However, the normal decorative wooden door structure appears as shown in FIG. 1 with the panel members 50 connected to the adjacent support frame assembly 36 by a conventional tongue and groove connection. This is not satisfactory in a fire burn test as one side of the groove burns through and the door panel members then fall out. This is best understood as if the male connector assembly 60 was a single projection into a single slot in the female connector assembly 62. After a burn test, there would be nothing to keep the panel members 50 from moving laterally.

Therefore, we have the double connector assembly 54 of this invention to permit a thickness indicated at "B" in FIG. 2 in the outer edge 58 and still pass the fire resistant testing.

Figure 3A:
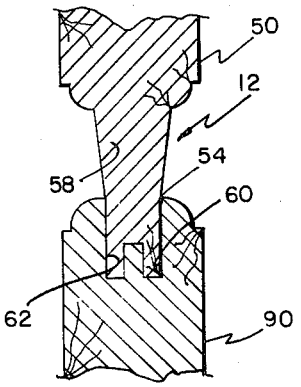
FIGS. 3A, 3B, and 3C are views similar to FIG. 2 showing the changes occurred in appearance during an actual fire burn test.
Figure 3B:
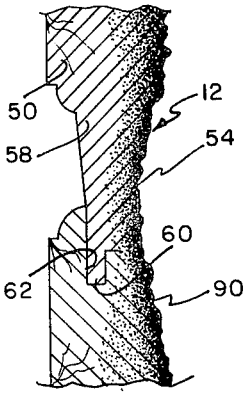

First, the normal assembled condition of the fire resistant wood door structure 12 is shown in FIG. 3A and a fire test is to be conducted on a side indicated at 90. The side 90 is subjected to a flame for a period of twenty (20) minutes with the results shown in FIG. 3B.

Figure 3C:
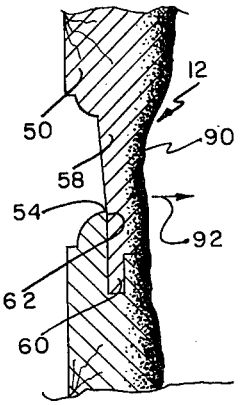

Next, the side 90 is subjected to a 30 PSI hose stream test which removes a few of the burned particles to achieve the end result as shown in FIG. 3C.

In a normal door structure, the wood would burn through a distance indicated at "C" in FIG. 2 and the door panel member 50 would fall out as indicated by an arrow 92 in FIG. 3C. However, it is seen that the inner leg member 70 is held between the inner sidewall surface 76 and a portion of the central connector projection 74 and the panel member 50 cannot move laterally. Thus, our fire resistant wood door structure 12 passes the subject test requirement.

As shown in FIG. 3C, the normal burn test removes about ⅓ the doors normal ("1¾ inch" thickness which can be tolerated by the double connector assembly 54 of this invention.)

It is also noted that the connector area of the double connector assembly 54 is a distance indicated at "D" and "E" in FIG. 2 whereby "E" is substantially greater than the expected "⅓" burn through of the door structure to achieve the new and novel result of this invention.

The fire resistant wood door structure of this invention has undergone special testing by Underwriters Laboratory for fire resistance and is the only known wood panel door to pass the fire test known as ANSI/U.L. 10B1978 including the hose stream test. By passing this test, the door structure of this invention can be specified by architects for many building uses where metal doors and wood flush doors could be previously used.

The Underwriters Laboratory test under ANSI/U.L. 10B1978 includes the following steps:

(1) The door structure to be tested is placed within a brick retaining wall.

(2) One side of the door is subjected to an intense fire on a time temperature curve from 0 to 20 minutes and 0 to 1462 F. temperature. More specifically, the time-temperature is as follows:

Start—Room Temperature
5 minutes—1000 F.
10 minutes—1300 F.
20 minutes—1462 F.

(3) Immediately after the 20 minute burn period, the burned side of the door is subjected to a hose stream test from: (A) a 2½ inch water supply hose; (B) discharged through a tapered nozzle with a 1⅛ inch outlet opening; (C) regulated to a 30 PSI discharge pressure; (D) applied a distance of 20 feet from the door structure; and (E) the time period of application of the water stream against the middle and all exposed parts of the door structure is controlled.

The door structure passes this testing procedure if no door panel members are disengaged from the supporting door frame assembly or any openings are created. The new and novel door structure of this invention passed the above described testing procedure.

While the invention has been described in conjunction with preferred specific embodiments thereof, it will be understood that this description is intended to illustrate and not to limit the scope of this invention, which is defined by the following claims:

We claim:

1. A fire resistant door structure constructed of a wood material adapted to pass testing laboratories' fires resistant specification, comprising:

(a) a door assembly including a support frame assembly having a panel assembly connected thereto:

(b) said panel assembly including a plurality of panel members, each of said panel members secured at outer peripheral edges of an adjacent portion of said support frame assembly by a double connector assembly.

(c) said double connector assembly including a male connector assembly mounted within a female connector assembly;

(d) said male connector assembly includes a pair of projecting connector leg members;

(e) said female connector assembly includes a connector cavity to receive said connector leg members therein and a connector projection integral with said support frame assembly extended between said connector leg members; and (f) an outer end of said connector projection not extended beyond an adjacent edge of said support frame assembly;

whereby a fire test applied to one side of said door structure may burn through one of said connector leg members but said panel members are held in place by the other one of said connector leg members.

2. A fire resistant door structure as described in claim 1 wherein:

(a) said connector leg members are parallel to each other formed with a connector slot therebetween;

(b) said connector projection is firmly mounted in said connector slot to present a solid air sealed connection; and (c) a portion of said outer end of said connector projection at a distance from an outer junction of said support frame assembly and said panel assembly greater than the thickness of wood material in said door structure to be consumed by a conventional fire test.

3. A fire resistant door structure as described in claim 1, wherein:

(a) said door structure constructed of the wood material that will burn through less than $\frac{1}{3}$ the thickness of said peripheral edges after a twenty (20) minute burn test and said panel members will then withstand a thirty (30) PSI water hose test without becoming disengaged from said support frame assembly.

4. A fire resistant door structure as described in claim 1, wherein:

(a) said support frame assembly and said panel members subjected to a testing laboratory fire resistant specification known as a ANSI/U.L. 10B 1978 fire burn test, (b) after said fire burn test, (1) said panel members and their said peripheral edges are solid without openings therein; and (2) one of said connector leg members and an adjacent portion of said connector projection is left intact and capable of holding said panel members therein.

* * * * *